US005511522A

United States Patent [19]

Tran

[11] Patent Number: 5,511,522

[45] Date of Patent: Apr. 30, 1996

[54] INTERNAL COMBUSTION ENGINE PRE-IGNITION OIL PUMP

[76] Inventor: Thuan V. Tran, 120 Ozone Dr., Hammond, La. 70403

[21] Appl. No.: 339,675

[22] Filed: Nov. 14, 1994

[51] Int. Cl.[6] ..... F01M 5/00

[52] U.S. Cl. ..... 123/196 S; 184/6.3

[58] Field of Search ..... 123/196 R, 196 S, 123/179.5; 184/6.3

[56] References Cited

U.S. PATENT DOCUMENTS

| | | | |
|---|---|---|---|
| 2,357,606 | 9/1944 | Nutt | 123/196 S |
| 4,094,293 | 6/1978 | Evans | 123/196 S |
| 4,531,485 | 7/1985 | Murther | 123/196 R |
| 4,893,598 | 1/1990 | Stasiuk | 123/196 S |
| 4,936,272 | 6/1990 | Whitmore | 123/196 S |
| 4,940,114 | 7/1990 | Albrecht | 123/196 S |
| 5,000,143 | 3/1991 | Brown | 123/196 S |
| 5,014,820 | 5/1991 | Evans | 123/196 S |
| 5,018,491 | 5/1991 | Fish | 123/196 S |
| 5,121,720 | 6/1992 | Roberts | 123/196 S |
| 5,159,313 | 10/1992 | Kawai et al. | 123/196 S |
| 5,168,845 | 12/1992 | Peaker | 123/196 S |
| 5,372,219 | 12/1994 | Peralta | 123/196 S |

FOREIGN PATENT DOCUMENTS 940909 11/1963 United Kingdom .

*Primary Examiner*—Erick R. Solis
*Attorney, Agent, or Firm*—Richard C. Litman

[57] ABSTRACT

An apparatus to pre-lubricate an engine to avoid undue wear and to augment an engine's main lubrication pump with an auxiliary oil pump attached between the oil filter and the engine which directs lubrication from the engine's sump through the existing filter and into the engine's conventional lubrication circuit.

3 Claims, 1 Drawing Sheet

INTERNAL COMBUSTION ENGINE PRE-IGNITION OIL PUMP

BACKGROUND OF THE INVENTION

1. Field of the Invention

This invention relates to engine lubrication systems, particularly to pre-ignition engine lubrication.

2. Description of the prior art

U.S. Pat. No. 2,357,606 issued Sep. 5, 1944 to A. Nutt describes a pre-ignition oiler which comprises an electric oil pump which draws oil from a sump and delivers the unfiltered oil to various engine parts through passageways which are independent of the engine's normal operating lubrication system. Unlike the present invention, the reference system is not seen to filter oil drawn from the sump, fails to utilize the operating lubricating system's oil passageways, and lacks modularity such that incorporation in an extant system would require substantial reworking of the engine.

U.S. Pat. No, 4,094,293 issued Jun. 13, 1978 to J. W. Evans describes a pre-ignition oiler which comprises a cylinder. Compressed air fills one side of the chamber which a piston divides; the other side acts as an oil reservoir. Low oil pressure triggers a solenoid to allow the piston to pump oil into the engine's lubrication system. The reservoir is recharged when the oil pressure has reached normal operating conditions. Evans'preoiler is dependent on maintaining a separate reservoir of oil rather than relying on the system's extant reservoir as is the case in the instant invention. Evans'pre-oiler depends on maintaining compressed air in the system unlike the present invention and does not filter the oil prior to its introduction into the engine system.

Great Britain Patent No, 940,909 published Nov. 6, 1963 and issued to Daimler-Benz Aktiengesellschaft (DBA) describes an engine pre-oiler which comprises a fluid circuit which includes a separate pre-oil pump, and which feeds into the operating lubrication system. DBA's system also includes a check valve to ensure the pre-oil pump experiences no back flow when the operating oil pump is in service. However, DBA's system fails to ensure that the operating oil pump and sump experience no back-flow while the pre-oil pump is in service.

None of the above inventions and patents, taken either singly or in combination, is seen to describe the instant invention as claimed.

SUMMARY OF THE INVENTION

When a conventional engine is idle and cold, the lubricant which normally coats the engine parts and protects them from excessive wear and heat build-up has typically seeped out of the passageways or galleys among and supplying these parts. During ignition cranking and initial running, the engine parts interact without the benefit of lubrication and suffer greater wear until the engine's main pump is able to deliver adequate lubrication to these parts. Reducing or eliminating this initial abuse will greatly increase the life and performance of an engine. The instant invention proposes to augment an engine's conventional lubrication system by drawing from the same sump as the main pump and supplying the same lubrication circuit. The instant invention also proposes to introduce only filtered oil into the lubrication circuit to reduce wear on the engine parts.

In consideration of the above, an object of the invention is to insure an adequate supply of oil to the engine prior to and during engine ignition by means of an auxiliary pump which will provide lubrication to the engine prior to ignition.

Another object of the invention is to insure an adequate supply of oil to the engine while it is operating by means of an auxiliary pump which will provide lubrication to the engine during episodes when the main pump does not adequately lubricate the engine.

A further object of the invention is to provide for easy adaptability of the invention to conventional engine systems which are or will be in service.

Yet another object of the invention is to provide improved elements and their arrangement in an apparatus for the purposes described which is inexpensive, dependable and effective.

These and other objects of the present invention will become readily apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
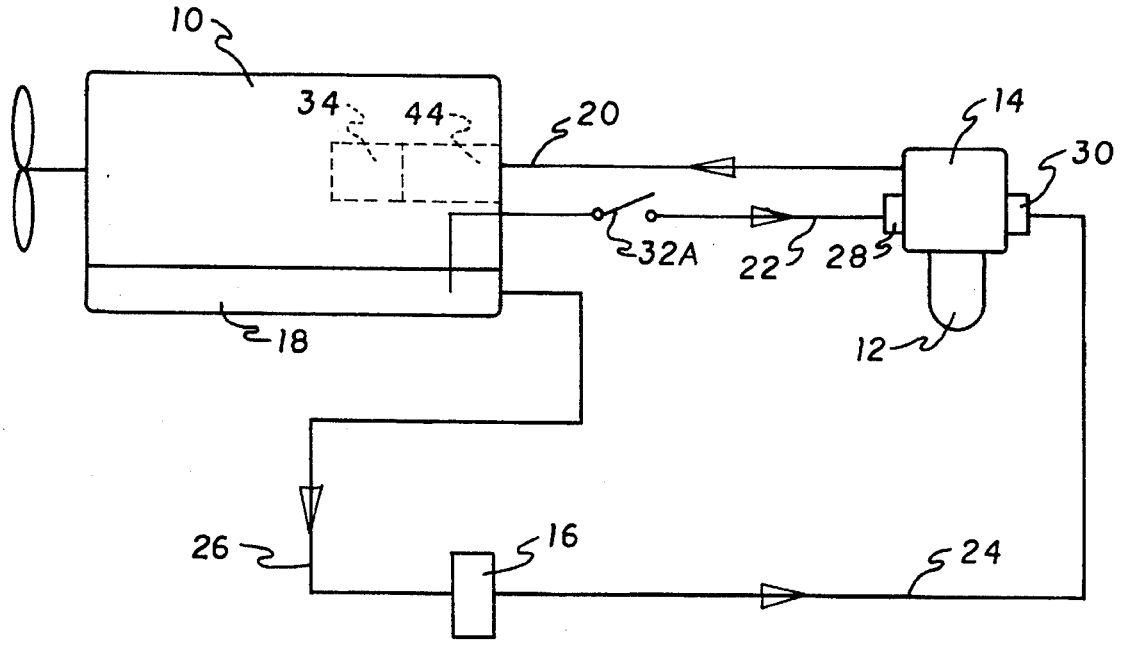
FIG. 1 is a diagrammatic view of an embodiment of the invention showing an engine, auxiliary oil pump, oil filter, check valves and switches appropriate to carry out the invention.
Figure 2:
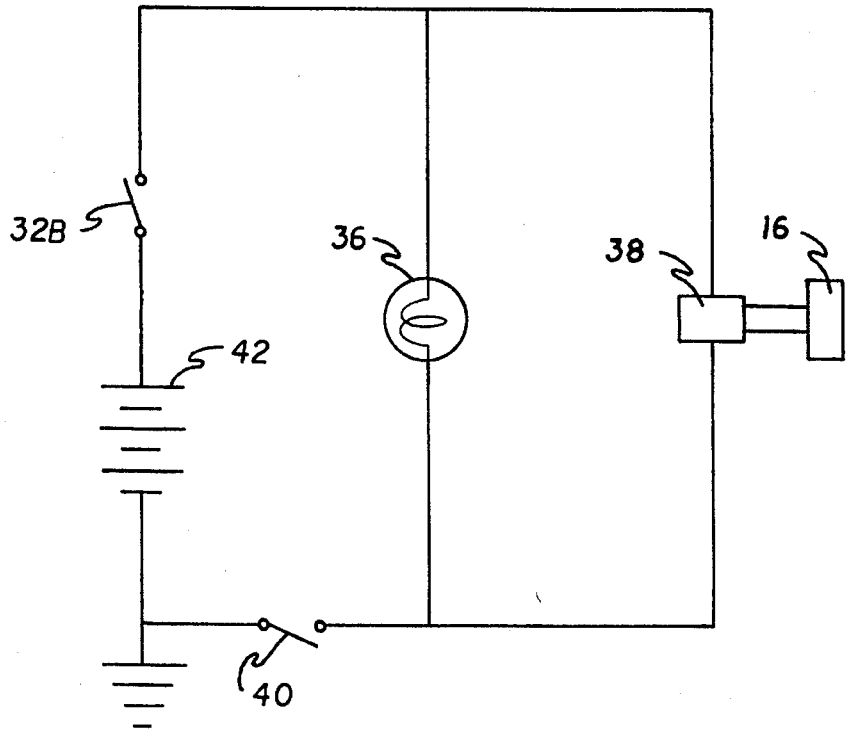
FIG. 2 is a schematic view of an embodiment of the invention showing the electrical components necessary to carry out the invention.

Referring to the FIG. 1 schematic diagram, prior to ignition and with the ignition key inserted to engage the battery 42 by closing key switch 40, or any other circumstance when low pressure exists in the oil filter feed line 22 of the lubrication circuit such as main or primary pump 44 failure, an oil pressure sensitive switch 32A registers such and, as shown in FIG. 2, electrical switch 32B completes the electrical circuit which includes the auxiliary pump relay switch 38 and energizes the auxiliary or secondary pump 16. With the electrical circuit completed, a dashboard lamp 36 is also energized by the vehicle's battery 4 and advises the operator literally that the auxiliary pump 16 is in service. The auxiliary pump 16 draws oil from the sump 18 through the sump line 26 which is shown in FIG. 1 as being entirely, physically distinct from the oil filter feed line 22, and delivers lubrication through the auxiliary line 24 to a one-way check valve 30. The check valve 30 promotes flow to the filter adaptor 14 and discourages flow in the other direction so that when the main pump 44 is operating, unfiltered lubrication is not allowed into the engine 10 via the sump 18, auxiliary line 24, auxiliary pump 16 and sump line 26. The filter adaptor 14 directs lubrication from the check valve 30 into the filter 12 and then into the engine 10. The auxiliary pump 16 delivers lubrication to the engine parts which otherwise suffer tremendous wear during the time it takes the main pump 44 to deliver adequate lubrication. Lubrication will flow off the engine parts and, aided by gravity, collect in the sump 18.

When the engine 10 has been adequately lubricated, the sending unit 34 will alert the operator that ignition is appropriate. As the engine begins to turn over while it is being started, the main pump 44 will begin pumping lubrication through the oil filter feed line 22, a one-way check valve 28 and the filter adaptor 14 into the filter 12. The check valve 28 is intended to prohibit flow, when the auxiliary pump 16 is in service, from the auxiliary line 24 to the oil filter feed line 22 and through the filter 12 which could be damaged. From the filter 12, lubrication flows through the oil filter return line 20 into the engine 10.

When the switch 32 detects that the pressure in the oil filter feed line 22 originating in the sump 18 has reached a pressure consistent with adequate engine lubrication, electrical switch 32B will break the electrical circuit which includes the auxiliary pump relay switch 38 and de-energize the auxiliary pump 16. The dashboard lamp 36 within this electrical circuit will also be de-energized and advise the operator that the auxiliary pump 16 is no longer in service.

During the course of normal operation, the sending unit 34 and the oil pressure sensitive switch 32A monitor the lubrication circuit to determine the adequacy of the lubrication in the engine 10. In the event the main pump 44 fails, the oil pressure sensitive switch 32A will sense the lubrication inadequacy and automatically engage the auxiliary pump 16 and alert the operator by the dashboard lamp 36 that the auxiliary pump 16 is in service. While the auxiliary pump 16 is replenishing the lubrication circuit, the sending unit 34 may sense that inadequate lubrication exists in the engine 10 and send a brief warning to the operator; should the auxiliary pump 16 ultimately fail to adequately lubricate the engine 10, the oil sending unit 34 will send a sustained warning to the operator.

The present invention is not intended to be limited to the sole embodiment described above, but to encompass any and all embodiments within the scope of the following claims.

I claim:

1. A secondary pre-ignition oil pump system for an internal combustion engine comprising:

a lubrication circuit for an internal combustion engine;

a primary oil pump of said internal combustion engine;

an oil sump that collects oil passing through said lubrication circuit;

a primary oil-drawing conduit means that draws oil from said oil sump under a force provided by said primary oil pump;

a secondary oil pump;

a secondary oil-drawing conduit means that draws oil from said oil sump under a force provided by said secondary oil pump, said secondary oil-drawing conduit means being separate from said primary oil-drawing conduit means, whereby blockage of one of said oil-drawing conduit means does not affect drawing of oil through the other of said oil-drawing conduit means;

a secondary check valve that ensures that oil flows in said secondary oil-drawing conduit means away from said oil pump;

an oil filter adapter that receives oil from said primary oil pump and from said secondary oil-drawing conduit means;

an oil filter that filters oil received by said filter adapter;

a return conduit means that receives oil from said filter and returns received oil to said lubrication circuit; and a pressure sensitive switch that senses oil pressure in said primary oil-drawing conduit means and activates said secondary pump when the oil pressure in said primary oil-drawing conduit means decreases below a predetermined level, whereby the pressure sensitive switch is activated prior to the running of the internal combustion engine.

2. The secondary pre-ignition oil pump system according to claim 1, further including a dashboard indicator lame indicating whether said secondary oil-drawing conduit means is drawing oil.

3. The secondary pre-ignition oil pump system according to claim 1, wherein said oil filter adapter is dimensioned and configured to retrofit said secondary pre-ignition oil pump system to existing engine lubrication systems.

* * * * *